US007467711B2

(12) United States Patent
Tambo

(10) Patent No.: US 7,467,711 B2
(45) Date of Patent: Dec. 23, 2008

(54) CHAMFERED HARD PACK FOR ROD-SHAPED SMOKING ARTICLES AND BLANK FOR MAKING THE SAME

(75) Inventor: Hitoshi Tambo, Tokyo (JP)

(73) Assignee: Japan Tobacco Inc., Tokyo (JP)

( * ) Notice: Subject to any disclaimer, the term of this patent is extended or adjusted under 35 U.S.C. 154(b) by 12 days.

(21) Appl. No.: 11/330,087

(22) Filed: Jan. 12, 2006

(65) Prior Publication Data

US 2006/0169605 A1 Aug. 3, 2006

Related U.S. Application Data

(63) Continuation of application No. PCT/JP04/10134, filed on Jul. 15, 2004.

(30) Foreign Application Priority Data

Jul. 16, 2003 (JP) ..... 2003-275479

(51) Int. Cl.
*B65D 85/10* (2006.01)
*B65D 43/16* (2006.01)

(52) U.S. Cl. ..... 206/273; 206/265; 229/160.1

(58) Field of Classification Search ..... 206/264–268, 206/273; 229/109, 149, 160.1
See application file for complete search history.

(56) References Cited

U.S. PATENT DOCUMENTS

| | | | | |
|---|---|---|---|---|
| 4,753,384 | A | 6/1988 | Focke et al. | |
| 5,207,322 | A * | 5/1993 | Focke et al. | 206/268 |
| 5,833,060 | A * | 11/1998 | Draghetti et al. | 206/268 |
| 5,896,984 | A * | 4/1999 | Focke et al. | 206/268 |
| 5,904,244 | A * | 5/1999 | Focke et al. | 206/268 |
| 6,079,556 | A | 6/2000 | Draghetti et al. | |
| 6,199,687 | B1 * | 3/2001 | Tambo et al. | 206/268 |
| 6,302,322 | B1 * | 10/2001 | Focke et al. | 229/160.1 |
| 6,360,943 | B1 * | 3/2002 | Focke et al. | 229/160.1 |
| 7,100,763 | B2 * | 9/2006 | Draghetti | 206/268 |

FOREIGN PATENT DOCUMENTS

| | | | |
|---|---|---|---|
| GB | 2175884 | A | 12/1986 |
| JP | 62-16334 | A | 1/1987 |
| JP | 11-49134 | A | 2/1999 |
| JP | 2001-171655 | A | 6/2001 |
| WO | WO-02/064451 | A1 | 8/2002 |

* cited by examiner

*Primary Examiner*—Bryon P Gehman
(74) *Attorney, Agent, or Firm*—Birch, Stewart, Kolasch & Birch, LLP

(57) ABSTRACT

A tongue-lid cigarette pack comprises a box part (2) of a parallelepiped shape, and a tongue lid (4) for opening and closing an open end (6) of the box part (2). On lateral edges (40) of the box part (2), chamfered edges (42) extending from a bottom wall (38) of the box part (2) over a specified length are formed. The chamfered edges (42) have a width ranging between 0.8 mm and 2 mm.

8 Claims, 10 Drawing Sheets

CHAMFERED HARD PACK FOR ROD-SHAPED SMOKING ARTICLES AND BLANK FOR MAKING THE SAME

This application is a Continuation of copending PCT International Application No. PCT/JP2004/010134 filed on Jul. 15, 2004, which designated the U.S, and on which priority is claimed under 35 U.S.C. § 120. This application also claims priority under 35 U.S.C. § 119(a) on Patent Application No(s). 2003-275479 filed in Japan on Jul. 16, 2003. The entire contents of each of the above documents is hereby incorporated by reference.

TECHNICAL FIELD

This invention relates to a hard pack for rod-shaped smoking articles such as filter cigarettes and a blank for making the pack.

BACKGROUND ART

A hard pack of this type is disclosed in Japanese Unexamined Patent Publication No. 2001-171655, for example. This known hard pack is called a hinged-lid pack, and comprises a box part and a lid for opening and closing an open end of the box part, where the lid is hinged at a rear edge of the open end. The box part contains an inner package k having a bundle of 20 filter cigarettes and a wrapper wrapped around the cigarette bundle.

Generally, smokers often carry a cigarette pack in a breast pocket of a garment such as a shirt. This seems to be because smokers can take out the cigarette pack very easily when they want to smoke.

However, both the box part and the lid of the cigarette pack have a parallelepiped shape, so that the box part and the lid have sharp lateral edges. Hence, when the cigarette pack is put into a breast pocket, the breast pocket tends to become caught on the sharp lateral edges. Thus, it is not always easy to insert the cigarette pack into a breast pocket.

In order to solve this problem, it is thinkable to round the sharp lateral edges of the cigarette pack. In this case, however, an ordinary packing machine cannot be used and a dedicated packing machine is required.

DISCLOSURE OF THE INVENTION

An object of this invention is to provide a hard pack for rod-shaped smoking articles which can be made using an ordinary packing machine and which can be easily inserted into a breast pocket or the like, and a blank for making the pack.

In order to achieve this object, a hard pack according to this invention comprises a hard box part of a parallelepiped shape, having an open end and a bottom wall; a lid joined to the open end of the box part to open and close the open end; and an inner package contained in the box part, the inner package including a plurality of rod-shaped smoking articles and an inner wrapper wrapped around the rod-shaped smoking articles. According to this invention, the box part further includes a front wall, a rear wall, two side walls, and chamfered edges formed on lateral-edges where the front wall and the rear wall meet the side walls, and the chamfered edges extend from the bottom wall over a specified length and have a width ranging between 0.8 mm and 2 mm.

Since the box part is a little narrower in its lower part extending to the bottom wall, when a user puts the hard pack into a breast pocket of a garment, the breast pocket does not become caught on the hard pack. Thus, the pack can be easily inserted into the breast pocket.

Since the width of the chamfered edges is limited to the range of 0.8 to 2 mm, the hard pack with the chamfered edges can be made even with an ordinary packing machine, only by adding fold lines for the chamfered edges to a blank for the hard pack.

Further, the chamfered edges of the box part give an interestingly new and unusual appearance to the hard pack.

Specifically, the box part can further include a slit formed in the front wall. In this case, the lid includes a main part for closing the open end of the box part, and a tongue extending integrally from the main part and adapted to be able to be inserted through the slit into the interior of the box part and thereby close the open end. The hard pack having a box part and a lid arranged like this is called a tongue-lid pack.

Alternatively, the box part can further include an inner frame for forming part of the open end. In this case, the lid has a parallelepiped shape adapted to cover and thereby close the open end. The hard pack having a box part and a lid arranged like this is similar in shape to an ordinary hinged-lid pack, except for the chamfered edges.

When the hard pack has a shape similar to the hinged-lid pack, the chamfered edges can be formed on the lateral edges of the box part over the entire length thereof, and desirably, chamfered edges are also formed on cross edges of the bottom wall of the box part over the entire length thereof. In this case, chamfered edges can be also formed on lateral edges and cross edges of the lid.

A blank for making the tongue-lid or hinged-lid hard pack includes fold lines for forming the lateral edges, and the fold lines each including a pair of branch fold lines in a part specified for forming the chamfered edge. In this case, the paired branch fold lines are separated from each other by a distance ranging between 0.8 mm and 2 mm. The paired fold lines make it possible to form the chamfered edges on the lateral edges by an ordinary packing machine's folding action, easily and with certainty.

The blank can include fold bands for forming the lateral edges and cross edges, where the fold bands each comprise a plurality of parallel linear impressed marks. In this case, it is desirable that the blank further includes a cut at each location where the fold bands meet each other, to separate the fold bands from each other.

BEST MODE FOR CARRYING OUT THE INVENTION

Figure 1:
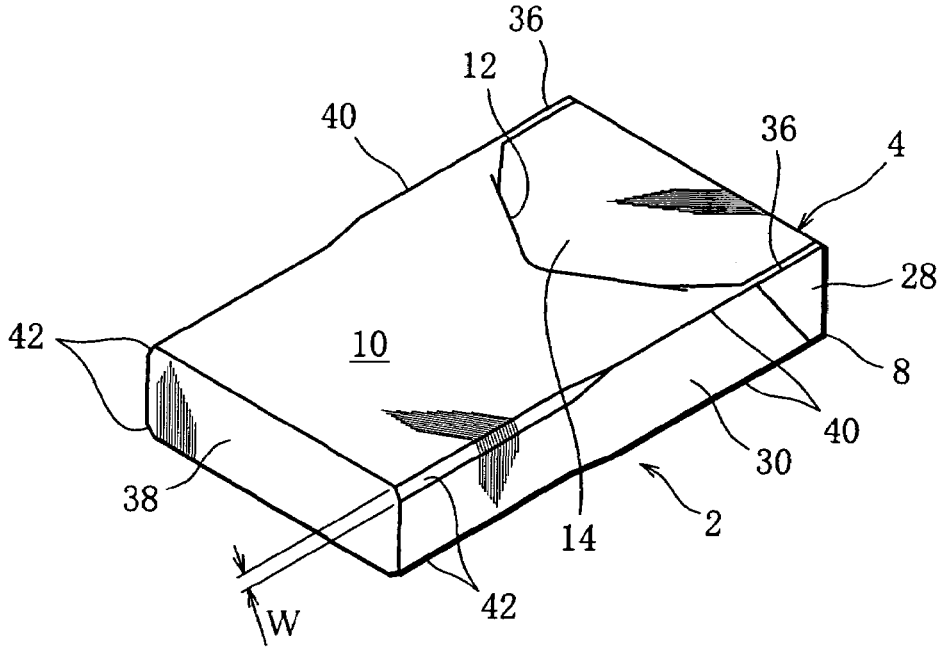
[FIG. 1] A perspective view showing a cigarette pack in an embodiment.
Figure 2:
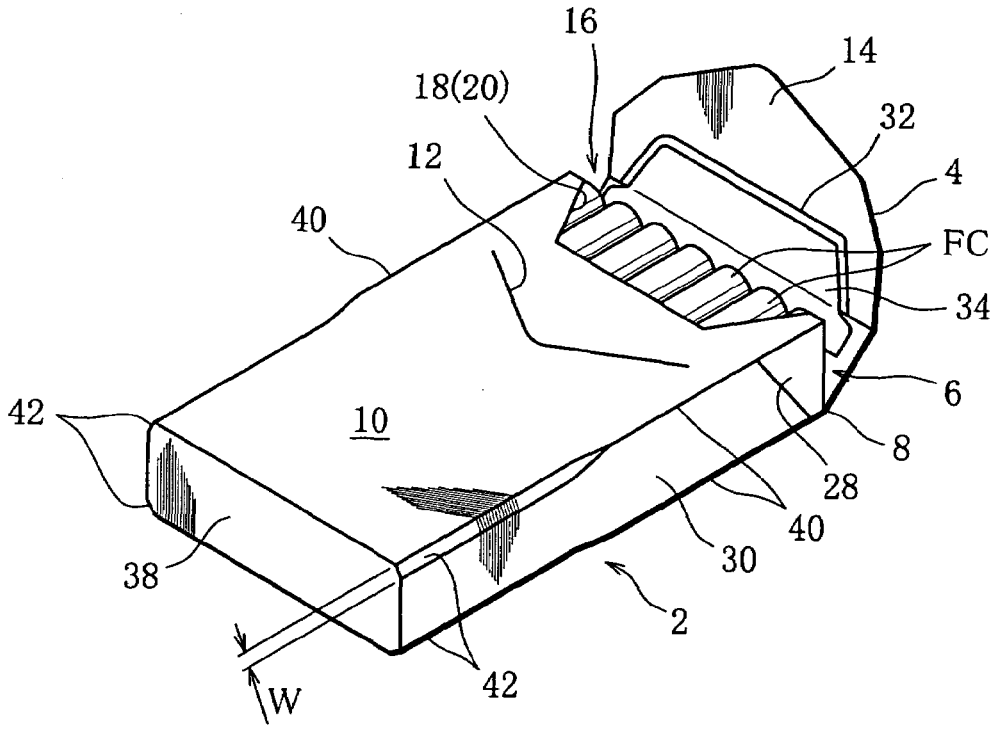
[FIG. 2] A perspective view showing the cigarette pack of FIG. 1 in an open state.

FIGS. 1 and 2 show a cigarette pack. This cigarette pack includes a box part 2 and a tongue lid 4. The tongue lid 4 is integrally joined to a rear edge of an open end 6 of the box part 2 by a self-hinge 8. Thus, the tongue lid 4 is turned about the self-hinge 8 to open and close the open end 6 of the box part 2.

More specifically, a slit 12 is formed in a front wall 10 of the box part 2. The slit 12 has a V-shape spreading out toward the open end 6. The tongue lid 4 has a tongue 14 at the end thereof. The tongue 14 is tapered and can be inserted into the V-slit 12. Hence, as clear from FIG. 1, when the open end 6 of the box part 2 is closed with the tongue lid 4, the tongue lid 4 is kept in a closed position with its tongue 14 inserted in the V-slit 12.

FIG. 2 shows the state in which the tongue lid 4 is opened. As clear from FIG. 2, an inner package 16 is contained in the box part 2. The inner package 16 comprises a cigarette bundle having 20 filter cigarettes FC and an inner wrapper wrapped around the cigarette bundle. The inner wrapper is, for example, an aluminum-deposited sheet or the like.

After the cigarette pack was made, when the tongue lid 4 of the cigarette pack is first opened, an almost U-shaped aperture 18 is formed in the front wall 10 of the box part 2. The aperture 18 formed extends into the open end 6 of the box part 2. At the same time as the aperture 18 is formed, part of the wrapper of the inner package 16, specifically, the part including a portion corresponding to the aperture 18 and a portion of the top of the inner package 16 is separated, whereby the inner package 16 is opened. Consequently, as shown in FIG. 2, part of the cigarette bundle in the inner package 16 appears in the aperture 18 with the inner wrapper removed.

Figure 3:
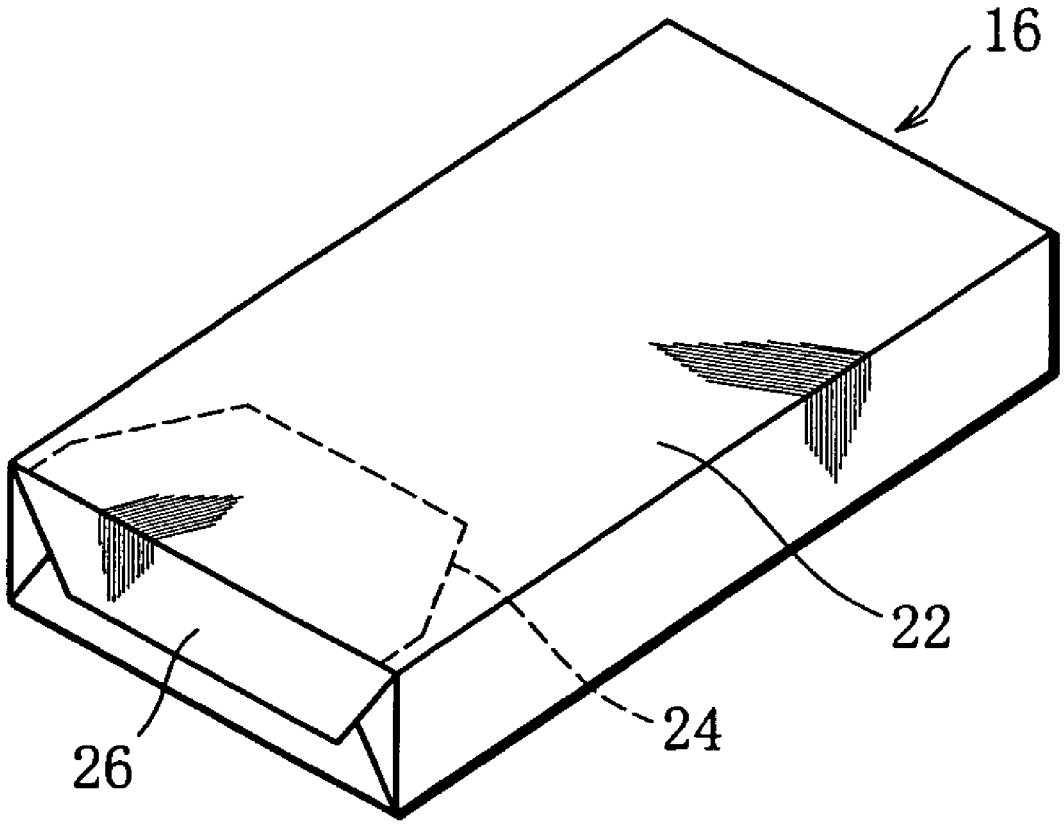
[FIG. 3] A perspective view showing an inner package contained in the cigarette pack of FIG. 1.

For this, a cutoff line 20 for the aperture 18 is formed in the front wall 10 of the box part 2 in advance. The cutoff line 20 is located between the V-slit 12 and the open end 6. Further, as shown in FIG. 3, a separation line 24 describing an almost U-like shape is formed in the inner wrapper 22 of the inner package 16 in advance. At the time the cigarette pack has been made, the cutoff line 20 in the box part 2 is located on the separation line 24 in the inner wrapper 24, and the separation line 24 ends at the place where a folded-down flap 26 of the inner wrapper 22 begins. The folded-down flap 26 forms part of the closed top face of the inner package 16, and is located to the outer side of the other parts which also form the top face of the inner package 16.

The separation line 24 defines the part to be separated from the inner wrapper 22, and the cutoff line 20 defines a part to be cut off the front wall 10 of the box part 2. At the time the cigarette pack has been made, the to-be-separated part and the to-be-cut-off part are bonded together, and the to-be-cut-off part of the front wall 10 and the folded-down flap 26 of the inner wrapper 22 are both bonded to the inside of the tongue lid 4.

Further, at the time the cigarette pack has been made, the tongue lid 4 has a pair of folded-down lugs 28. The folded-down lugs 28 are connected with the tongue lid 4 on both sides thereof, with a separation line between, and bonded to the side walls 30 of the box part 2.

Hence, until the cigarette pack is first opened, the tongue lid 4 is bonded to the box part 2 by means of the pair of folded-down lugs 28. When the cigarette pack is first opened, or in other words, the tongue lid 4 is first turned from a closed position to an open position, the separation line between the tongue lid 4 and each folded-down lug 28 breaks, so that the tongue lid 4 is separated from the folded-down lugs 28. Consequently, the tongue lid 4 becomes able to turn freely about the self-hinge 8.

When the tongue lid 4 is turned to the open position, the to-be-cut-off part is cut off the front wall 10 of the box part 2 to form a cut piece 32. By this, the above-mentioned aperture 18 is formed in the front wall 10. Further, at the same time as the cut piece 32 is formed, the to-be-separated part is separated from the inner wrapper 22 of the inner package 16 to form a separated piece 34.

As mentioned above, since the to-be-cut-off part and the folded-down flap 26 are bonded to the inside of the tongue lid 4, the cut piece 32 and the separated piece 24 are kept bonded to the inside of the tongue lid 4 as shown in FIG. 2.

As mentioned above, when the cigarette pack is first opened, the tongue lid 4 is separated from the folded-down lugs 28, which leaves break marks 36 on both sides of the cigarette pack as shown in FIG. 1. The fact that the break marks 36 are left serves to prevent somebody from tampering with cigarette pack, effectively. Thus, the cigarette pack in FIG. 1 shows that it has been already opened.

Further, as clear from FIGS. 1 and 2, the box part 2 have four longitudinal or lateral edges 40, and chamfered edges 42 are formed on the lateral edges 40. Each chamfered edge 42 extends from the bottom wall 38 of the box part 2 toward the open end 6 of the box part 2 over a specified length, and merges into the sharp lateral edge 40.

Specifically, the chamfered edge 42 has a maximum width ranging between 0.8 mm and 2 mm, preferably between 0.9 mm and 1.5 mm, and about half the length of the side wall 30.

Figure 4:
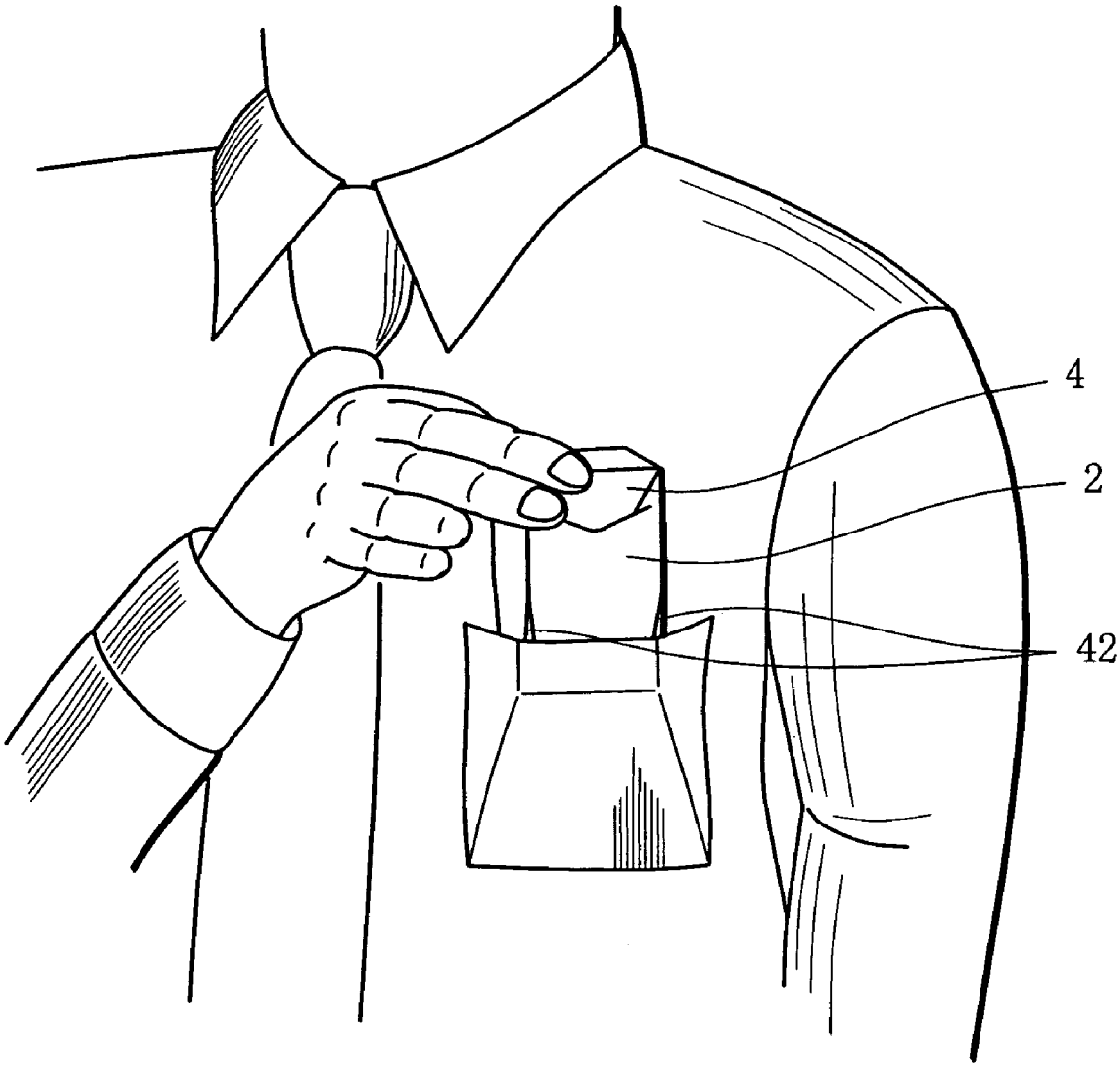
[FIG. 4] An illustration showing how the cigarette pack of FIG. 1 is inserted into a breast pocket of a garment.

In the cigarette pack described above, the four corners of the bottom wall 38 of the box part 2 are chamfered as the chamfered edges 42. Hence, as shown in FIG. 4, when a smoker puts the cigarette pack into a breast pocket of a garment, the cigarette pack can be inserted easily without the garment getting caught on the lateral edges 40 of the cigarette pack.

Further, the chamfered edges 42 not only make the cigarette pack, specifically, the box part 2 easier to grasp, but also give an interestingly new and unusual appearance to the cigarette pack.

Figure 5:
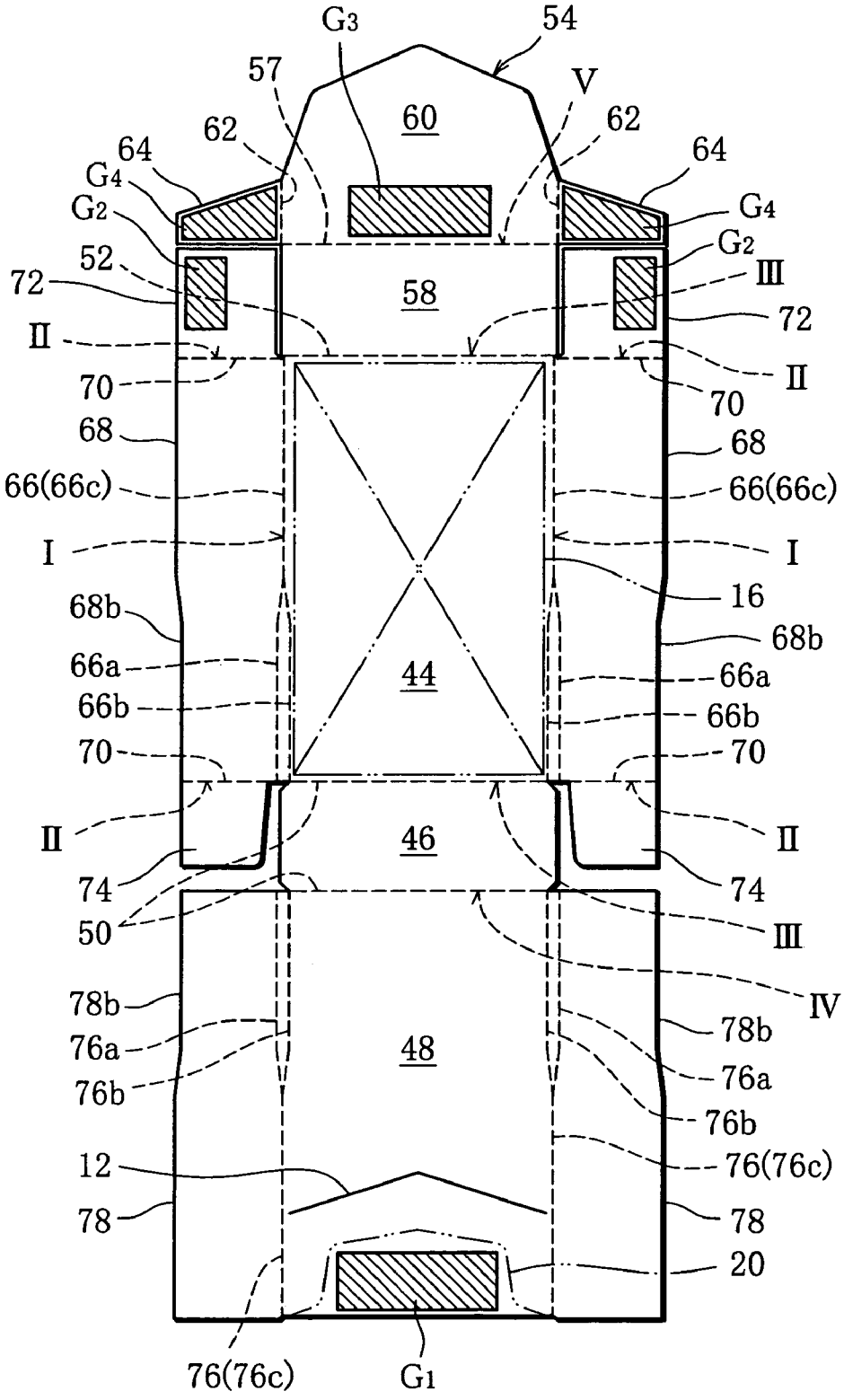
[FIG. 5] A diagram showing a blank for making the cigarette pack of FIG. 1.

FIG. 5 shows a blank (inside) for making the cigarette pack of FIG. 1.

The blank includes a rear panel 44, a bottom panel 46 and a front panel 48 in the center. Viewed in FIG. 5, from the top downward, these panels 44, 46, 48 are aligned, and divided by horizontal fold lines 50.

The panels 44, 46, 48 are parts for forming the rear wall, bottom wall 38 and front wall 10 of the box part 2, respectively. Hence, in the front panel 48, the above-mentioned V-slit 12 and cutoff line 20 are formed in advance.

The rear panel 44 is connected with a tongue lid panel 54 on the upper side, with a fold line 52 for forming the self-hinge 8 therebetween. The tongue lid panel 54 has a horizontal fold line 57, which divides the tongue lid panel 54 into a lid panel 58 on the fold line 52 side and a tongue panel 60. The tongue panel 60 has a tapering end.

The lid panel 58 is a part for forming the lid for closing the open end 6 of the box part 2, and the tongue panel 60 is a part which forms the tongue 14.

The tongue panel 60 has lug flaps 64 at the root thereof, on both sides. These lug flaps 64 are connected with the tongue panel 60, with the above-mentioned separation line 62 therebetween. These lug flaps 64 are parts for forming the above-mentioned folded-down lugs 28.

Further, the rear panel 44 is connected with inner side flaps 68 on both sides, with a fold line 66 therebetween. Each inner side flap 68 is connected with an inner top flap 72 on the upper side and an inner bottom flap 74 on the lower side, with a horizontal fold line 70 therebetween. The inner top flap 72 is a reinforcement member for the lid 58, and the inner bottom flap 74 is a reinforcement member for the bottom panel 46.

Meanwhile, the front panel 48 is connected with outer side flaps 78 on both sides, with a fold line 76 therebetween. Each outer side flap 78 is a part for forming the side wall 30 of the box part 2 with the corresponding inner side flap 68.

As shown in FIG. 5, each fold line 66 divides into a pair of branch fold lines 66*a*, 66*b* on the bottom panel 46 side. These branch fold lines 66*a*, 66*b* diverge from the fold line 66 to the left and the right, respectively, and then run toward the bottom panel 46, parallel to each other. The other part of each fold line 66 is left as a single fold line 66*c*.

Each fold line 76 divides into a pair of branch fold lines 76*a*, 76*b* on the bottom panel 46 side, like the branch fold lines 66*a*, 66*b*. The other part of each fold line 76 is left as a single fold line 76*c*.

The branch fold lines 66*a*, 66*b*; 76*a*, 76*b* are parts for forming the above-mentioned chamfered edges 42.

Further, the outer edges of the side flaps 68, 78 have indentations 68*b*, 78*b* formed to correspond to the branch fold lines 66*a*, 66*b*; 76*a*, 76*b*. The indentations 68*b*, 78*b* have a shape similar to the corresponding fold lines 76*b*, 66*b*. The outer edge of each inner bottom flap 74 is aligned with the indentation 68*b*.

Shaded areas in FIG. 5 are glue-applied areas provided on the blank. These glue-applied areas are newly added in the blank in this embodiment.

More specifically, the glue-applied area $G_1$ on the front panel 48 is located within a region defined by the cutoff line 20, namely on the to-be-cut-off part. Thus, the glue-applied area $G_1$ can bond the inside of the to-be-cut-off part to the to-be-separated part of the inner package 16.

The glue-applied areas $G_2$ on the left and right inner top flaps 72 can bond the inside of the inner top flaps 72 to the side flap 26 of the inner package 16. The glue-applied area $G_3$ on the tongue panel 60 can bond the inside of the tongue panel 60 to the outside of the to-be-cut-off part.

Further, the glue-applied areas $G_4$ on the left and right lug flaps 64 can bond the inside of the lug flaps 64 to the outside of the outer side flaps 78.

Figure 6:
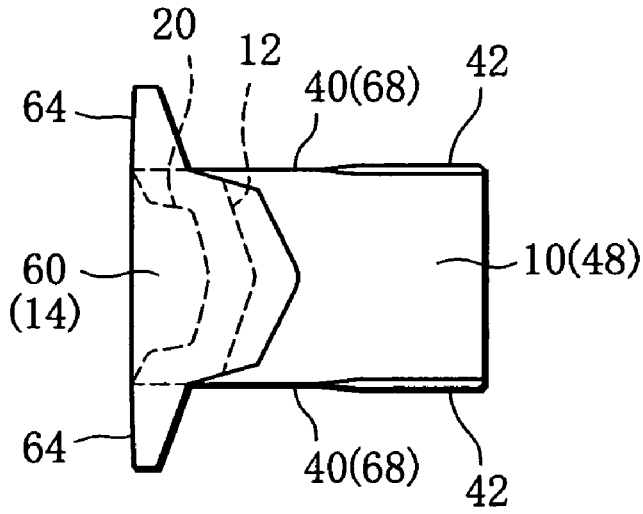
[FIG. 6] A diagram for explaining the process of folding the blank of FIG. 5.

The above-described blank first receives the inner package 16 on the rear panel 44. Then, the flaps and panels of the blank are folded onto the inner package 16 along the above-mentioned fold lines in the order of I to V shown in FIG. 5. Consequently, an intermediate pack shown in FIG. 6 is obtained. In the intermediate pack of FIG. 6, the tongue panel 60 is laid over the outside of the front panel 48, namely the front wall 10.

Then, the left and right lug flaps 64 of the tongue panel 60 are folded along the separation lines 62 and bonded to the outside of the outer side flaps 78. Consequently, as shown in FIG. 7, the forming of the cigarette pack by folding is completed, or in other words, the cigarette pack is completed.

Figure 7:
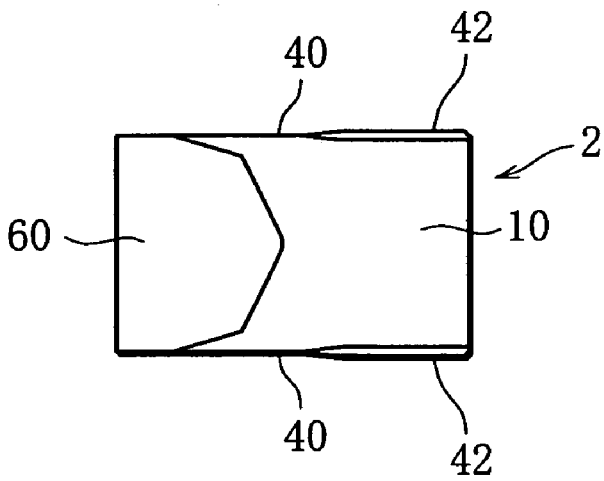
[FIG. 7] A diagram for explaining the process of folding the blank of FIG. 5.

As clear from FIG. 7, at the time the cigarette pack has been made, the tongue 14 is just laid over the front wall 10 of the box part 2 to cover the V-slit 12, not inserted into the V-slit 12.

The above-mentioned chamfered edges 42 are formed at the same time as the inner and outer side flaps 68, 78 are folded. Specifically, regarding the fold line 66, the distance W between the branch fold lines 66*a*, 66*b* (see FIGS. 1 and 2) is small as mentioned above. Hence, the inner side flap 68 is folded following the fold lines 66*a*, 66*b*, 66*c* when folded along the fold line 66.

Also regarding the fold line 76, since the distance between the branch fold lines 76*a*, 76*b* is small, the outer side flap 78 is folded following the fold lines 76*a*, 76*b*, 76*c* when folded along the fold line 76.

Thus, the longitudinal edges 40 of the box part 2 are formed according to the fold lines 66*c*, 76*c*, while the chamfered edges 42 of the box part 2 are formed according to the branch fold lines 66*a*, 66*b*; 76*a*, 76*b*.

These chamfered edges are formed by folding the inner and outer side flaps 68, 78 with a single action. This allows an ordinary packing machine to be used to fold this blank.

Since the outer edge of each inner side flap 68 has the indentation 68*b*, the outer edges of the inner side flaps 68, or in other words, the fold lines 66*a*, 66*b* do not interfere with the fold lines 76*a*, 76*b* of the outer side flaps 78 when the outer side flaps 78 are folded. Thus, the chamfered edges 42 of the front wall 10 of the box part 2 can be formed with certainty.

Further, since the outer edge of each outer side flap 78 has also the indentation 78*b*, the outer edges of the outer side flaps 78 do not hang over the chamfered edges 42 of the rear wall of the box part 2.

The present invention is not limited to the above-described embodiment. It can be modified in various ways.

Figure 8:
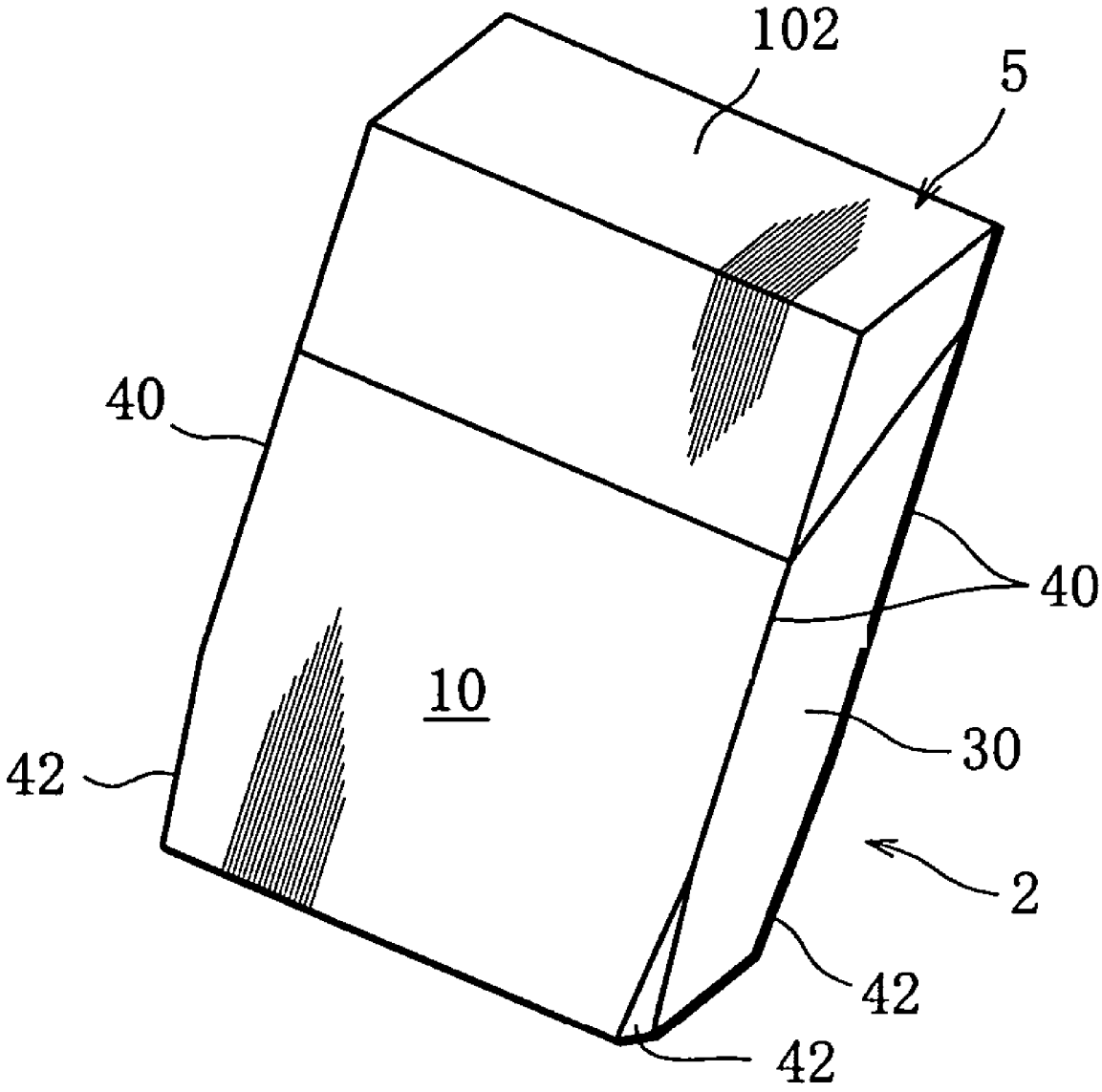
[FIG. 8] A perspective view showing a cigarette pack in an modified example, in a closed state.
Figure 9:
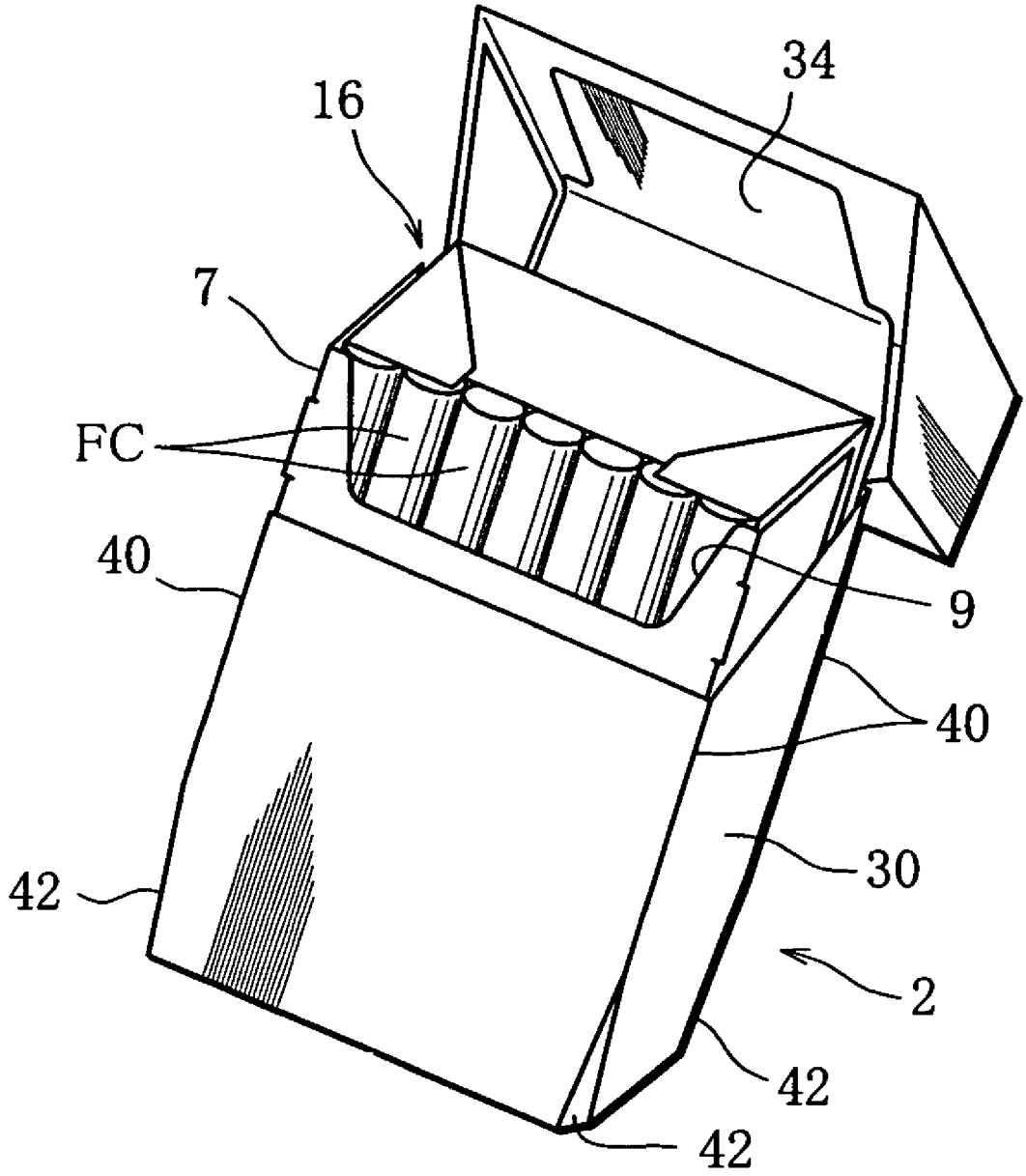
[FIG. 9] A perspective view showing the cigarette pack of FIG. 8 in an open state.

For example, the present invention can be applied not only to the tongue-lid pack but also to an ordinary hinged-lid pack shown in FIGS. 8 and 9.

The hinged-lid pack like this also includes a box part 2 and a lid 5, and the box part 2 includes an inner frame 7 (FIG. 9). The inner frame 7 forms a front part of an open end 6 of the box part 2 and has an aperture 9 corresponding to the above-mentioned aperture 18.

The lid 5 has a parallelepiped shape similar to the box part 2 and integrally joined to the rear wall of the box part 2 by a self-hinge 8. In this case, the lid 5 closes the open end 6 of the box part 2 to cover the part of the inner frame 7 not covered by the box part 2.

When the hinged-lid pack is first opened, or in other words, the lid 5 is first turned from a closed position to an open position, the turn of the lid separates a to-be-separated part of the inner package 16, from the inner package 16 at the same time. This separation forms a separated piece 34, which is kept to bonded to the inside of the lid 5 (FIG. 9).

In place of the aperture 9, the inner frame 7 can have a to-be-cut-off part defined by a cutoff line 20 as mentioned above. In this case, when the hinged-lid pack is first opened, an aperture 9 is formed by the to-be-cut-off part getting cut off and the to-be-separated part getting separated.

Figure 10:
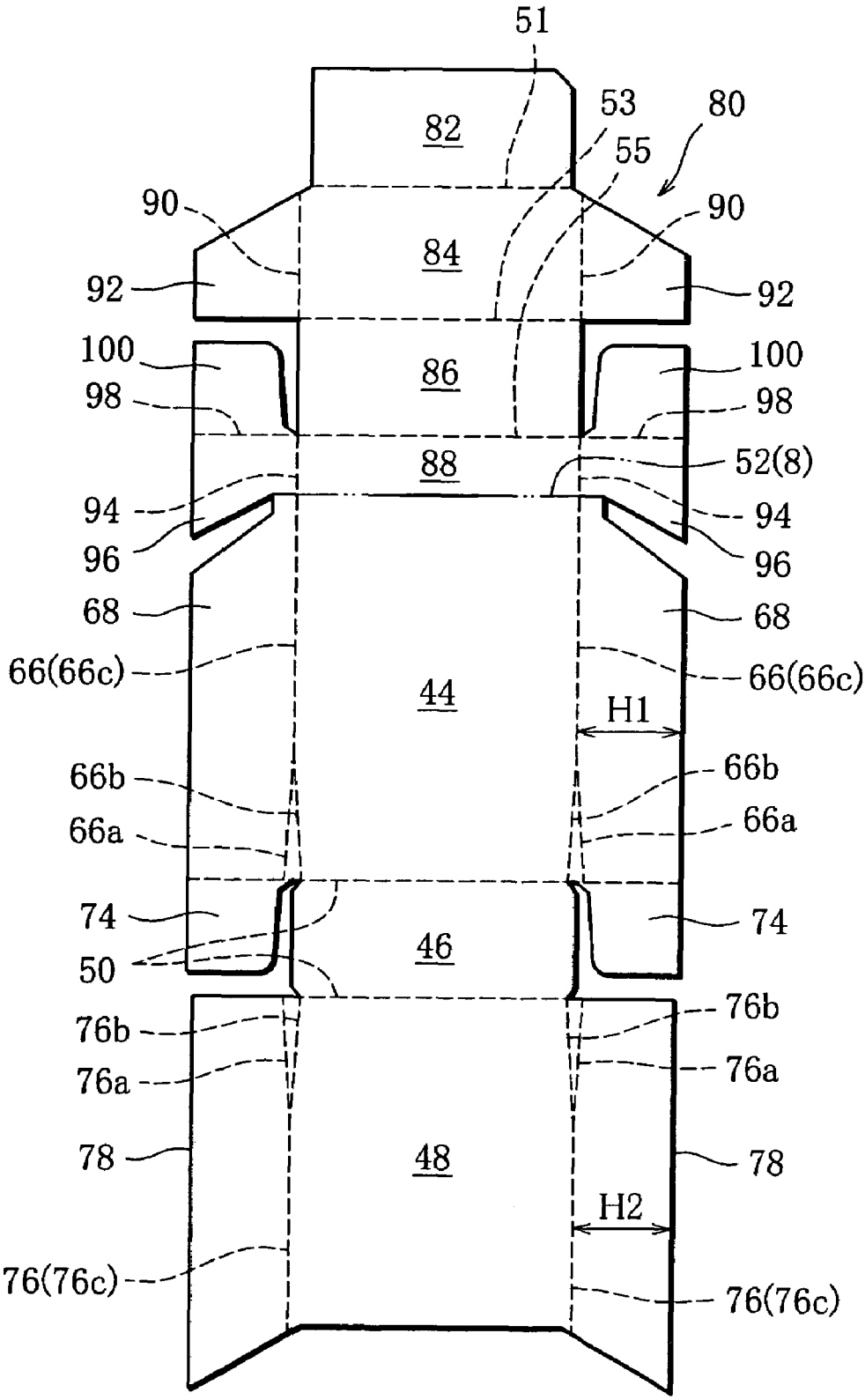
[FIG. 10] A diagram showing a blank for making the cigarette pack of FIG. 8.

FIG. 10 shows a blank for making the cigarette pack shown in FIGS. 8 and 9.

To avoid repetition in description, those parts of the blank of FIG. 10 which correspond to the panels and flaps of the blank of FIG. 5 are indicated by the same reference signs. Thus, regarding the blank of FIG. 10, only differences from the blank of FIG. 5 will be described below.

The blank of FIG. 10 includes a lid panel 80. The lid panel 80 is connected with a rear panel 44, with a fold line 52 therebetween. More specifically, viewed in FIG. 10, from the top downward, the lid panel 80 is divided into an inner front panel 82, an outer front panel 84, an outer top panel 86 and a lid rear panel 88. The lid rear panel 88 is connected with the rear panel 4, with the fold line 52, or in other words, the self-hinge 8 therebetween. Fold lines 51, 53, 55 demarcate between the panels 82 and 84, between the panels 84 and 86, and between the panels 86 and 88, respectively.

The outer front panel 84 is connected with outer side flaps 92 on both sides, with a fold line 90 therebetween, and the outer rear panel 88 is connected with inner side flaps 96 on both sides, with a fold line 94 therebetween. Further, each inner side flap 96 is connected with an inner top flap 100, with a fold line 98 therebetween.

The inner and outer front panels 82, 84 are laid over each other to form a front wall of the lid 5. The outer top panel 86 and the paired inner top flaps 100 are laid over each other to form a top wall 102 (see FIG. 8) of the lid 5. Further, the outer side flap 92 and the inner side flap 96 are laid over each other to form a side wall of the lid 5.

Since the process of folding the blank of FIG. 10 is known, the description thereof will be omitted. Also in the blank of FIG. 10, chamfered edges 42 are formed on lateral edges 40 of the box part 2 at the same time as the inner side flaps 68 and outer side flaps 78 are folded.

In the blank of FIG. 10, it is desirable that the width H1 of the inner side flap 68 be a little smaller than the thickness of the inner package 16, and that the width H2 of the outer side flap 78 be a little smaller than the width H1. In that case, the outer edge of the inner flap 68 or the outer flap 78 does not interfere with formation of the chamfered edge 42 nor hang over the chamfered edge 42.

In the tongue-lid pack and ordinary type hinged-lid pack described above, the chamfered edges 42 are formed on the lateral edges 40 of the box part 2 only partially. However, like in a cigarette pack shown in FIG. 11, the chamfered edges 42 can be formed on the lateral edges of the box part over the entire length thereof.

Figure 11:
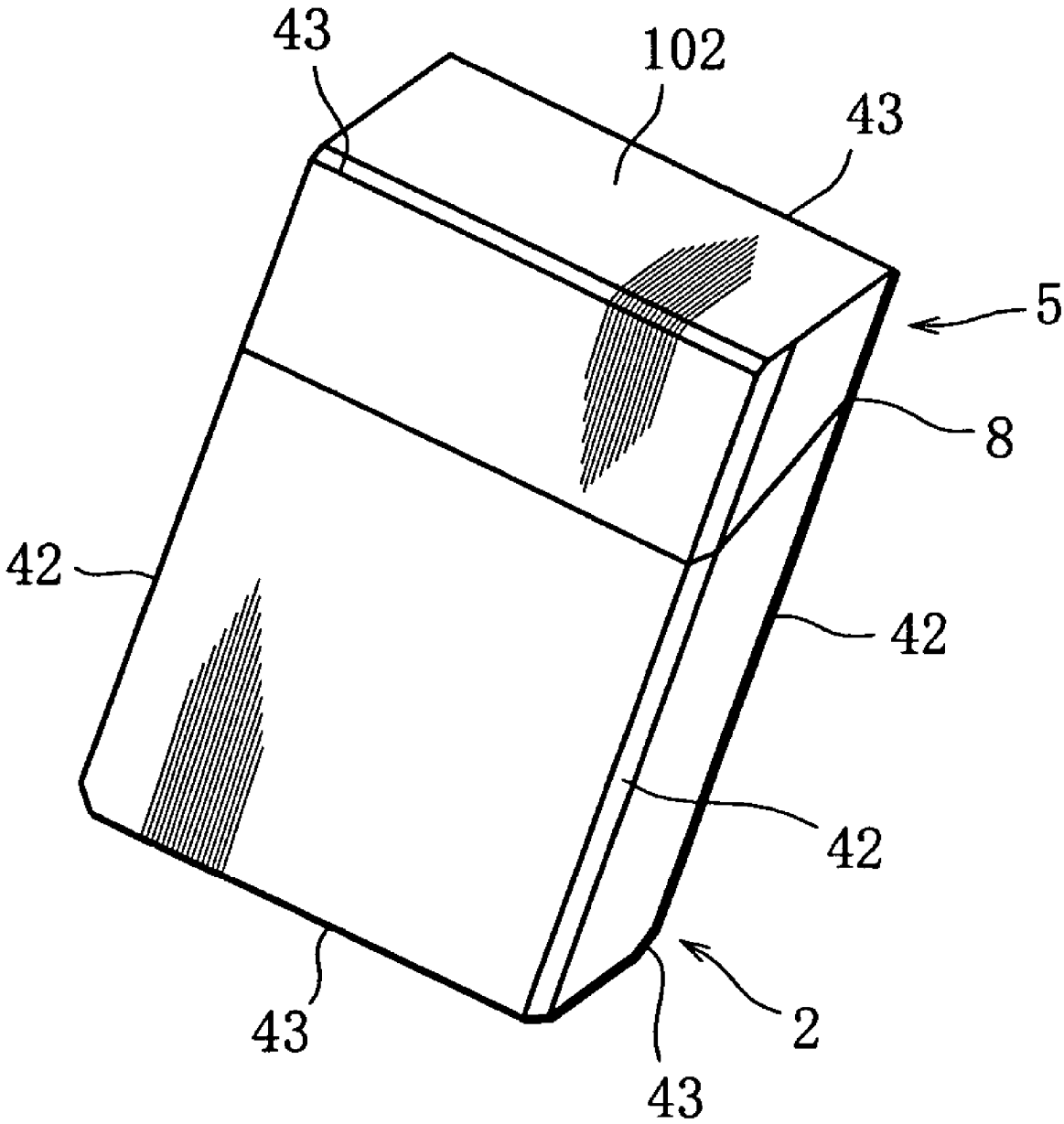
[FIG. 11] A perspective view showing a cigarette pack in another modified example, in a closed state.

In the cigarette pack of FIG. 11, chamfered edges 42 are formed further on cross edges of the bottom wall 38 and cross edges of the top wall over the entire length thereof.

Figure 12:
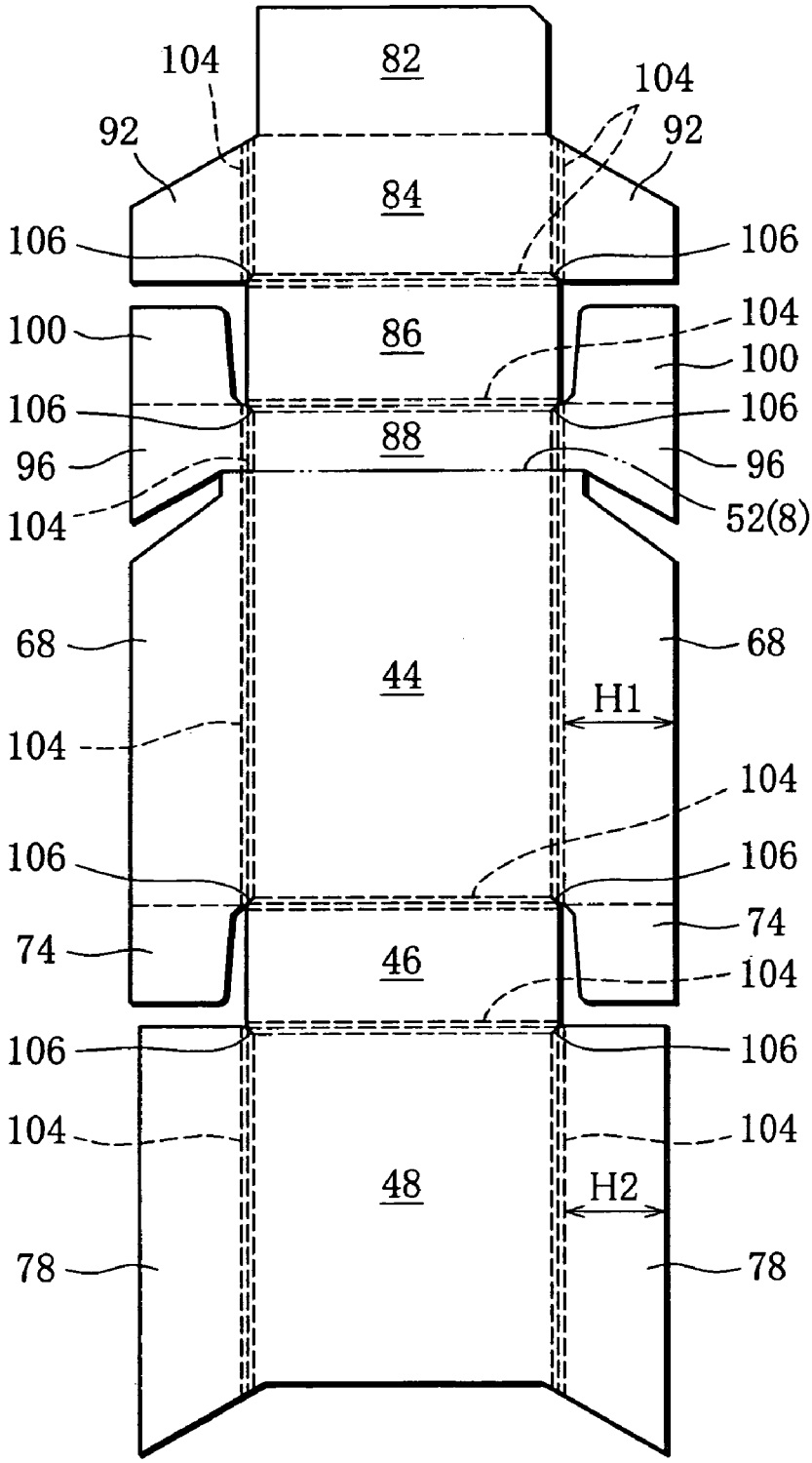
[FIG. 12] A diagram showing a blank for making the cigarette pack of FIG. 11.

FIG. 12 shows a black for making the pack of FIG. 11.

The blank of FIG. 12 is similar in shape to the blank of FIG. 10. In the blank of FIG. 12, the fold lines 50, 66 (66*a*, 66*b*, 66*c*), 76 (76*a*, 76*b*, 76*c*), 90, 53, 55 in the blank of FIG. 10 are replaced with fold bands 104. Each fold band 104 comprises a plurality, for example, three of parallel linear impressed marks.

Needless to say, the width of the fold band 104, namely the distance between the two outermost linear impressed marks ranges between 0.8 mm and 2.0 mm, preferably between 0.9 mm and 1.5 mm.

Further, as clear from FIG. 12, a cut 106 is made at each place where two fold bands meet at right angles. The cut 106 separates the two fold bands.

Since the width of the fold band 104 is limited to the above range, the pack of FIG. 11 having the chamfered edges 42, 43 can be made by folding the panels and flaps with a single action, provided that an ordinary packing machine is used to fold the blank of FIG. 12.

The cuts 106 not only make it easier to fold the panels and flaps but also help the chamfered edges 42, 43 be formed with certainty.

The invention claimed is:

1. A hard pack for rod-shaped smoking articles, comprising:

a hard box part of a parallelepiped shape, having an open end and a bottom wall, a lid joined to the open end of said box part to open and close the open end, and an inner package contained in said box part, said inner package including the rod-shaped smoking articles and an inner wrapper wrapped around the rod-shaped smoking articles, wherein said box part includes a front wall, a rear wall, two side walls, and first chamfered edges formed on lateral edges where the front wall and the rear wall meet the side walls, and the first chamfered edges extend from the bottom wall over a specified length and have a width ranging between 0.8 mm and 2 mm, each of the side walls is formed by superimposing an interior portion and an exterior portion, the interior portion and the exterior portion each include one lateral edge having a chamfer and the other lateral edge, and wherein the other lateral edge included in each one of the interior portion and the exterior portion has an indentation for avoiding interference with the chamfer included in the other of the interior portion and the exterior portion.

2. The hard pack according to claim 1, wherein said box part further includes a slit formed in the front wall, and said lid includes a main part adapted to close the open end of the box part, and a tongue extending integrally from the main part and adapted to be able to be inserted through the slit into the interior of said box part and thereby close the open end.

3. The hard pack according to claim 2, being made from a blank for making the box part and lid, and further including:

fold lines for forming the lateral edges, the fold lines each including a pair of branch fold lines in a part specified for forming the first chamfered edges, an inner side flap and an outer side flap adapted to form the interior portion and the exterior portion of each of the side walls, wherein the inner side flap and the outer side flap each include one lateral edge formed by a fold line and the other lateral edge, and the fold line includes a pair of branch fold lines in a part adapted to form the chamfer, and the other side edge of either one of the inner side flan and the outer side flap has an indentation or, the indentation being so disposed as to avoid contact or overlapping of the inner side flap and the outer side flap with respect to the other of the air of branch fold lines with the side walls are formed of the inner side flap and the outer side flap.

4. The hard pack according to claim 1, wherein said lid has a parallelepiped shape adapted to cover and thereby close the open end.

5. The hard pack according to claim 4, wherein the first chamfered edges are formed over the entire length of the lateral edges.

6. The hard pack according to claim 5, wherein said box part further includes a top wall, a bottom wall, and second chamfered edges formed on transverse edges where the top and bottom wails meet the front and rear wails, respectively, the second chamfered edges extending over the entire length of the transverse edges.

7. The hard pack according to claim 6, wherein said lid further includes lateral edges, transverse edges and third chamfered edges formed on the lateral edges and transverse edges thereof to extend over the entire length of the lateral edges and transverse edges.

8. The hard pack according to claim 7, being made from a blank for making the box part and lid, and further including:

a cut at each place where the fold bands meet each other, to separate the fold bands from each other.

* * * * *